US011479965B1

(12) United States Patent
Johnson

(10) Patent No.: US 11,479,965 B1
(45) Date of Patent: Oct. 25, 2022

(54) ACOUSTICAL ISOLATION HANGER

(71) Applicant: L.J. Avalon, LLC., Tampa, FL (US)

(72) Inventor: Lahnie Johnson, Tampa, FL (US)

(73) Assignee: L.J. Avalon LLC, Tampa, FL (US)

( * ) Notice: Subject to any disclaimer, the term of this patent is extended or adjusted under 35 U.S.C. 154(b) by 562 days.

(21) Appl. No.: 16/567,395

(22) Filed: Sep. 11, 2019

(51) Int. Cl.

| | |
|---|---|
| ***E04B 9/18*** | (2006.01) |
| ***E04B 1/84*** | (2006.01) |
| ***E04B 2/74*** | (2006.01) |
| ***E04B 1/82*** | (2006.01) |
| ***E04B 1/41*** | (2006.01) |

(52) U.S. Cl.
CPC ..... *E04B 1/84* (2013.01); *E04B 1/41* (2013.01); *E04B 1/8209* (2013.01); *E04B 2/7412* (2013.01); *E04B 2001/4192* (2013.01)

(58) Field of Classification Search
CPC . E04B 1/84; E04B 1/41; E04B 1/8209; E04B 2/7412; E04B 2001/4192
See application file for complete search history.

(56) References Cited

U.S. PATENT DOCUMENTS

| | | | | |
|---|---|---|---|---|
| 5,768,843 | A * | 6/1998 | Dziedzic | E04B 9/18 52/39 |
| 7,743,572 | B2 * | 6/2010 | Ducharme | G10K 11/16 52/167.1 |
| 8,413,398 | B1 * | 4/2013 | Allred | F16G 11/06 52/39 |
| 2006/0174562 | A1 * | 8/2006 | Insalaco | G09F 7/18 52/220.6 |

* cited by examiner

*Primary Examiner* — Patrick J Maestri
(74) *Attorney, Agent, or Firm* — Frijouf, Rust & Pyle P.A.

(57) ABSTRACT

An isolating hanger and method of making is disclosed for mounting a ceiling from an upper support. The isolating hanger comprises a one piece bendable wire having a spring shape defined between a first and a second wire end. The spring shaped is tempered for transforming said spring shape into a resilient spring. The remaining bendable wire ends affix the upper support to the ceiling for isolating vibration between the ceiling and the upper support.

18 Claims, 6 Drawing Sheets

PRIOR ART

PRIOR ART

ACOUSTICAL ISOLATION HANGER

BACKGROUND OF THE INVENTION

Field of the Invention

This invention relates to sound control and more particularly to improve the sound isolation for a suspended ceiling.

Background of the Invention

Drop ceilings are very common in commercial properties and can also be found in some residential homes. Drop ceilings are typically comprise interlocking tiles within a frame that is all suspended by metal wires that are secured to the above structure.

Drop ceilings create an area between an upper support and the drop ceiling that allows room for airducts, cabling, low and high voltage wires. In some cases, the area can be made plenum for air circulation aimed at heating and air-conditioning. The dropped ceiling also decreases the air volumes in the rooms which lowers heating the cooling costs. Finally, and importantly, drop ceiling early objective was to balance and control acoustics in the room.

Unfortunately, drop ceilings suffer from vibration transmission wherein the sound from the above floor from traveling through the non-resilient solid hanging wires or rods supporting the suspended ceiling below. It is well understood that sound travels not only through the air but especially through any mechanical connection that is not resilient. It is through this device connecting the floor above to the ceiling below that provides sufficient resilience to disallow sound transmission from the floor above to the ceiling below. A phrase commonly used for this is "acoustically floating the ceiling. Correctly installed the ceiling would also not touch any of the walls of the room, staying a quarter inch away from each wall and having that space filled with a resilient acoustical sealant.

Attempts to achieve a better acoustic performance in a room have been to use drop ceilings that include insulation, typically known as Sound Attenuation Batts (SABs) or "Sound Batts" to the top of the dropped ceiling. Other attempts have been to created large, cumbersome, and expensive hanger to help isolate vibrations from the above structure from reaching the drop ceiling and from vibrations produce in the room to the above structure.

There have been many in the prior art who have attempted to solve these problems with varying degrees of success. None, however completely satisfies the requirements for a complete solution to the aforestated problem.

The following U. S. Patents are my solution to solve and/or reduce acoustical issues of the prior art.

U.S. Pat. No. 7,063,184 to Johnson discloses an apparatus and method of making an improved sound reducing panel is disclosed suitable for use in an outdoor or a hazardous environment. The improved sound reducing panel comprises a water resistant sound absorbing member with a porous covering sheet overlaying a face surface of the sound absorbing member. A support frame is disposed about an outer perimeter of the sound absorbing member. An attachment secures the improved sound reducing panel to the support frame. In one embodiment, a sound blocking member is located adjacent to the sound absorbing member.

U.S. Pat. No. 7,513,082 to Johnson discloses a system is disclosed for reducing the transmission of acoustical energy between a first and second wall surface of a wall comprising a first and a second beam for supporting a sound panel. Each of the first and second beams comprises first and second flanges interconnected by an inner connector with a fold defined in the inner connector for reducing the transmission of acoustical energy between the first and second flange. The fold cooperates with one of the flanges for defining a pocket for receiving an edge of a sound panel. The first and second flange support the first and second wall surface of the wall with the sound panel.

U.S. Pat. No. 7,503,428 to Johnson discloses an apparatus and method is disclosed for an improved acoustic panel comprising a sound absorbing member defined by a first and second face surface and a plurality of peripheral edges. A sound blocking member is defined by a first and second face surface and a plurality of peripheral edge. The first face surface of the sound blocking member is secured relative to the second face surface of the sound absorbing member for blocking the transmission of sound therethrough. In another embodiment, the first face surface of the sound blocking member is spaced relative to the second face surface of the sound absorbing member for decoupling the sound blocking member from the sound absorbing member.

U.S. Pat. No. 8,739,924 to Johnson discloses an apparatus and method is disclosed for an improved acoustic panel comprising a sound absorbing member defined by a first and second face surface and a plurality of peripheral edges. A sound blocking member is defined by a first and second face surface and a plurality of peripheral edge. The first face surface of the sound blocking member is secured relative to the second face surface of the sound absorbing member for blocking the transmission of sound therethrough. In another embodiment, the first face surface of the sound blocking member is spaced relative to the second face surface of the sound absorbing member for decoupling the sound blocking member from the sound absorbing member.

It is an object of the present invention to continue to improve upon my prior inventions by providing a low cost solution for isolating suspending ceiling from an upper support.

Another object of this invention is to provide an isolation hanger that requires less labor times and training for installation.

Another object of this invention is to provide an isolation hanger that are compatible with a greater variety of separations distances between the above structure and the dropped ceiling.

Another object of this invention is to provide an isolation hanger that can be manufactured rapidly within a small facility.

Another object of this invention is to provide an isolation hanger that virtually eliminates all typical parts but one. Thus allowing in the simplest form a resilient hanger requiring no other parts, fixed or moving, that could wear out or disintegrate over time.

Another object of this invention is to provide an isolation hangar which requires virtually no tools to install, simply putting each and of the non-tempered wire through a hole or over a support member to acquire the height desired for the suspended ceiling and twisting the wire around itself to the length desired.

Another object of this invention is to provide an isolation hangar which is extremely inexpensive to ship as all can be laid into a simple box with no need for packaging isolation.

Another object of this invention is to provide an isolation hangar which has virtually unlimited shelf life in contrast to many other current hangers that use resilient materials i.e. rubber that will deteriorate through time.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an isolating hanger for mounting a ceiling from an upper support, comprising a bendable wire extending between a first wire end and a second wire end.

A spring shape is defined in the wire between the first wire end and the second wire end. The spring shaped is tempered for transforming the spring shape into a resilient spring. The first wire end and the second wire end remaining bendable for affixing the first wire end of the bendable wire to the upper support and for affixing the second wire end of the bendable wire to the ceiling for isolating vibration between the ceiling and the upper support.

In one example, the ceiling includes a ceiling grid of a suspended ceiling. The hanger is a one piece unit, metallic wire, includes a wire between 0.125 inches and 0.375 inches in diameter.

The spring shaped maybe transformed into the resilient spring by an induction heating process. The spring shaped may include a verity of shapes including a plurality of bends in two dimensions or a helical bend in three dimensions or an arc bend in two dimensions. The verity of shapes and dimensions of the spring shaped region can vary from what is illustrated. The spring shaped is tempered by a focused heat treating process between the first wire end and the second wire end.

In a more specific example of the invention, the invention relates to an isolating hanger for mounting a ceiling grid of a suspended ceiling from an upper support, comprising a bendable wire extending between a first wire end and a second wire end. A spring shape defined in the wire between the first wire end and the second wire end. The spring shaped being tempered for transforming the spring shape into a resilient spring. The first wire end and the second wire end remaining bendable for affixing the first wire end of the bendable wire to the upper support and for affixing the second wire end of the bendable wire to the ceiling grid for isolating vibration between the suspended ceiling and the upper support.

The invention is also incorporated in to the methods the process of making an isolating hanger for mounting a suspended ceiling from an upper support. The first method includes providing a bendable metallic wire, moving the bendable metallic wire along a path intermittently forming a spring shape spaced along the moving bendable wire. Heat treating only the spring shape regions of the bendable metallic wire.

Finally, this method includes severing the heat treated bendable wire between adjacent to the heat treated spring shape regions before chilling the treated spring shape regions.

The second method includes providing a bendable metallic wire, intermittently forming a spring shape spaced along the moving bendable wire, severing the bendable wire between adjacent the spring shape regions, moving the bendable metallic wire along a path and then heat treating only the spring shape regions of the bendable metallic wire.

Finally, the bendable metallic wire drops into a chilling bath to chill the heat treated spring shape regions.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
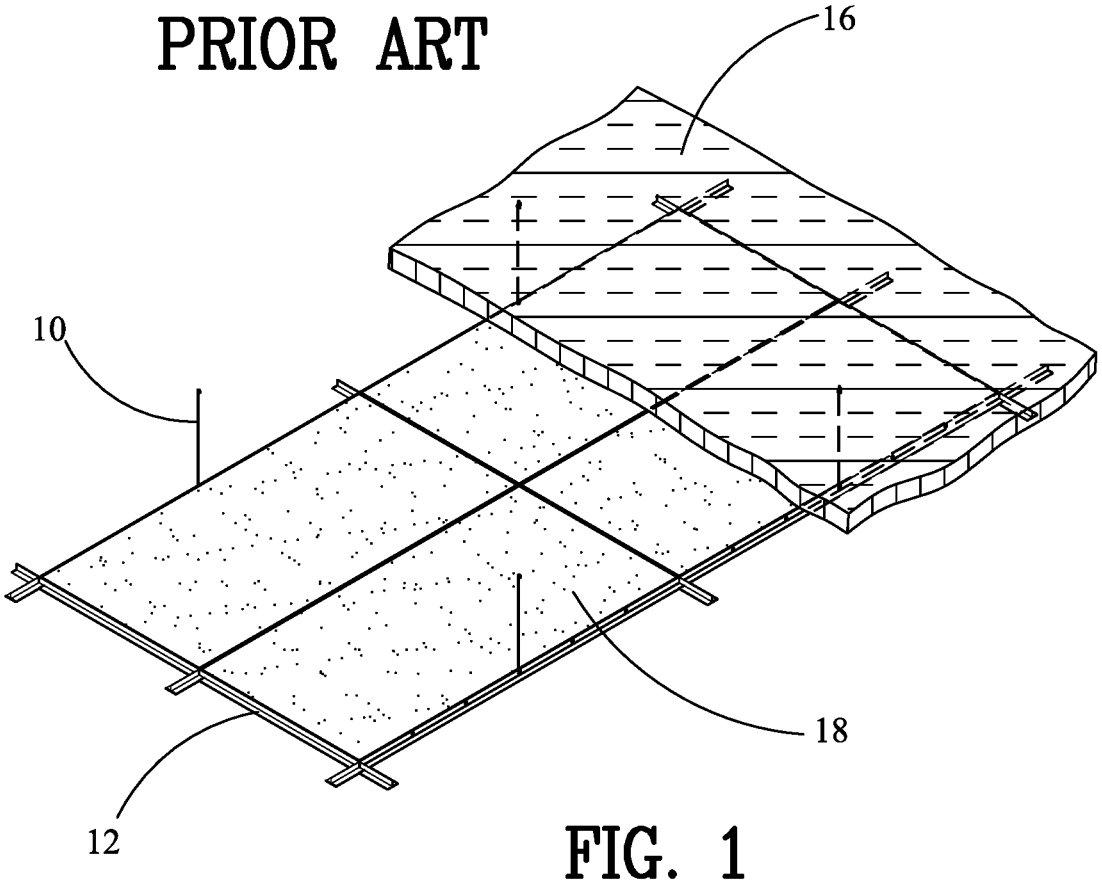
FIG. 1 PRIOR ART
FIG. 1 is a top isometric partially cut away view of a plurality of wire hangers of the prior art supporting a ceiling grid of a suspended ceiling.
Figure 2:
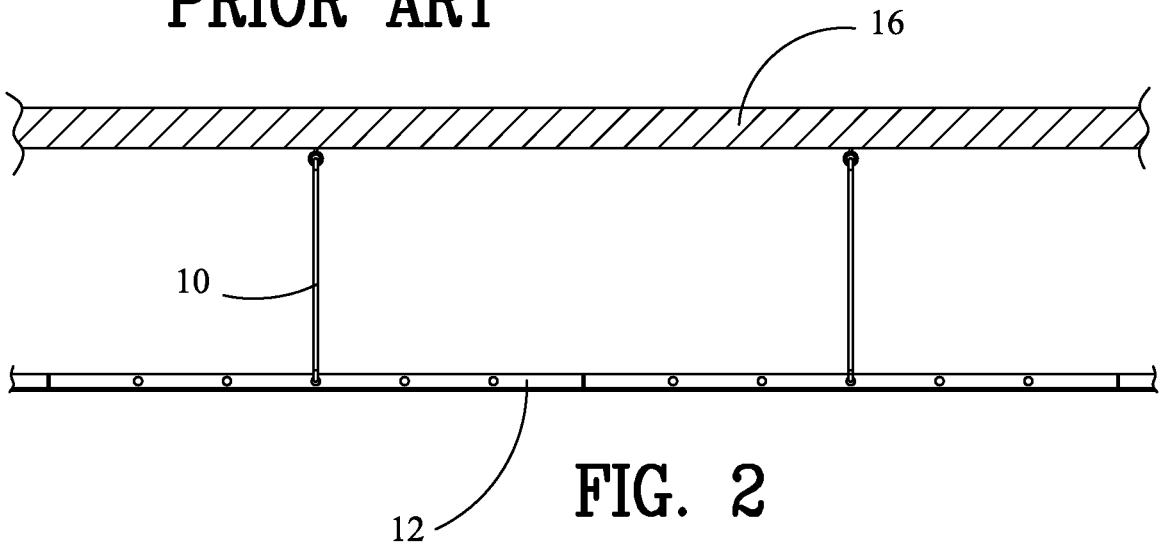
FIG. 2 is an enlarged side sectional view of a portion of FIG. 1.

FIG. 1 and FIG. 2 are prior art examples of a wire hanger (10) that is widely used in businesses and residential ceilings. FIG. 1 is a top isometric view showing the prior art wire hanger (10) and how the hangers are used to support a ceiling grid (12) of a suspended ceiling (14). FIG. 2 is an enlarged side sectional view of a portion of FIG. 1.

Figure 3:
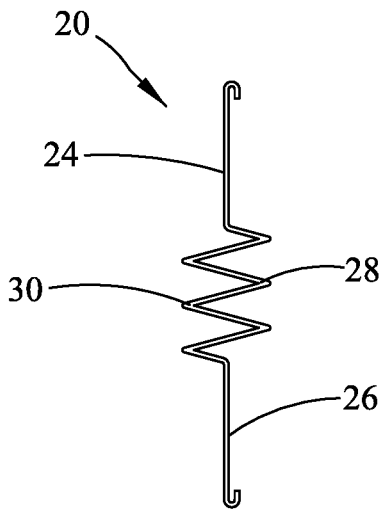
FIG. 3 is a first embodiment of the isolating hanger of the present invention.

FIG. 3 shows the first embodiment of the isolating hanger (20) of the present invention.

To understand the present invention completely, a basic understanding of business and residential suspended ceilings (14) must be understood. Suspended ceilings (14), are a secondary ceiling that are hung below an upper support (16) structure. These suspended ceilings (14), sometimes known as drop ceilings, typically include a ceiling grid (12), ceiling tiles (18), and wire hangers (10). The ceiling grid (12) are used to hold ceiling tiles (18), and the wire hangers (10) support the ceiling grid (12) by linking the ceiling grid (12) to an upper support (16) structure.

There are many advantages of installing suspended ceiling (14), first suspended ceilings (14) create a void between the upper support (16) and the suspended ceiling (14). This void allows room for airducts, cabling of low and high voltage wires, and in some cases this void can be made plenum for air circulation aimed at heating and air-conditioning. The suspended ceiling (14) also decreases the air volumes in the rooms which can lower heating the cooling costs. Finally, one of the early objective of the suspended ceilings (14) was to control and balance acoustics.

The object of suspended ceilings (14) when it was conceived and how it is used today was to isolate vibrations coming in and out of the room. The suspended ceilings (14) help sound vibrations originating from the upper support (16) or the outside from entering the room and from sound vibrations produce in the room, such as voice or music, to the upper support (16). To reduce these sound and mechanical vibrations, suspended ceilings (14) are typically installed with insulation, commonly known as Sound Attenuation Batts (SABs) or "Sound Batts," to the top of the ceiling tiles (18).

The straight wire hanger (10) used today can create a "tin can telephone" effect by conducting vibrations coming from the upper support (16) to the suspended ceilings (14), and vibrations coming from the suspended ceilings (14), to the upper support (16). Sound Batts help reduce vibrations in the suspended ceilings (14) but does not prevent the "tin can telephone" effect. To stop the "tin can telephone" effect, isolation in the wire hanger (10) between the upper support (16) to the suspended ceilings (14) is needed. The present invent stops the "tin can telephone" effect by isolating the upper support (16) from the suspended ceilings (14).

FIG. 3 shows the first embodiment of the isolating hanger (20) of the present invention. The isolation hanger (20) is a one piece bendable wire (22) that can be constructed from metallic material. The bendable wire (22) extends between a first wire end (24) and a second wire end (26). The bendable wire (22) includes a wire diameter between 0.125 to 0.375 Inches in diameter. However, the diameter of bendable wire (22) can be larger or smaller than the prescribed diameter to accommodate heavier or lighter suspended ceilings (14), or to provide extra strength to support suspended ceilings (14) accessories.

Figure 4:
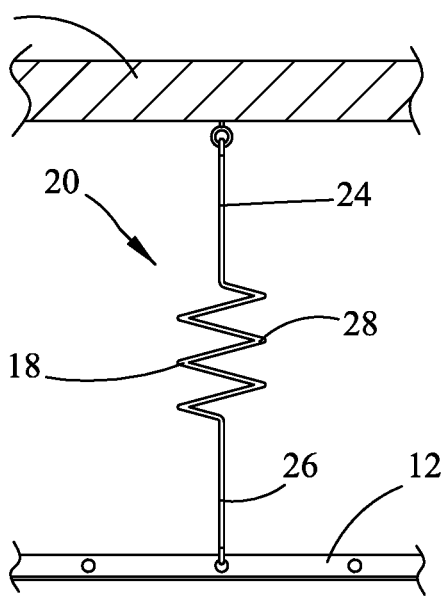
FIG. 4 is a side view of the isolating hanger of FIG. 3 supporting a suspended ceiling from an upper support.

FIG. 4 shows the isolating hanger (20) supporting a ceiling grid (12) from an upper support (16). The first wire end (24) and the second wire end (26) remain bendable for bending the first wire end (24) to either the ceiling grid (12) or the upper support (16) and for bending the second wire end (26) to the other of the ceiling grid (12) or the upper support (16). Preferably, the wire ends (24) and (26) are twisted about themselves as should be well known to those skilled in the art.

Figure 5:
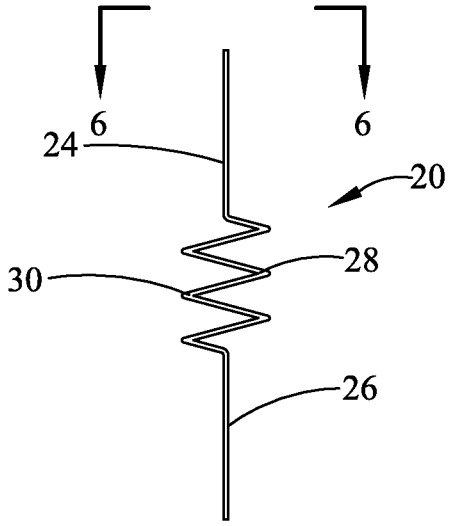
FIG. 5 is an enlarged view if the isolating hanger of FIG. 3.
Figure 6:
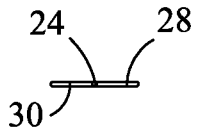
FIG. 6 is a top view along line 6-6 of FIG. 5.
Figure 8:
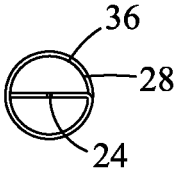
FIG. 8 is a top view along line 8-8 of FIG. 7
Figure 10:
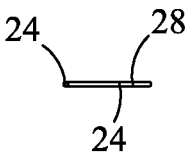
FIG. 10 is a top view along line 10-10 of FIG. 9.
Figure 11:
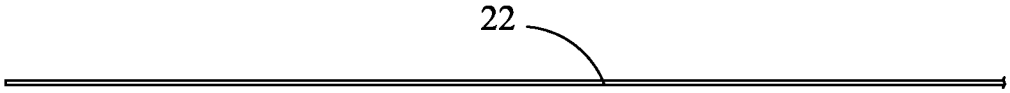
FIG. 11 is an unformed bendable wire
Figure 12:
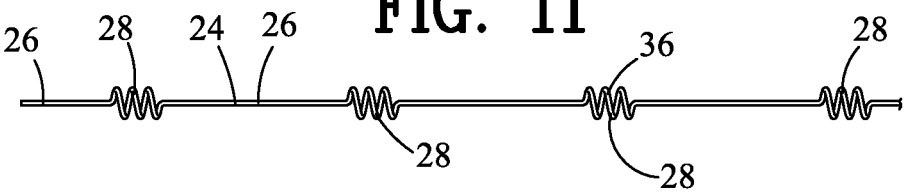
FIG. 12 illustrates the first step in forming the isolating hanger of the present invention including forming spaced apart spring shapes along a bendable wire.
Figure 15:
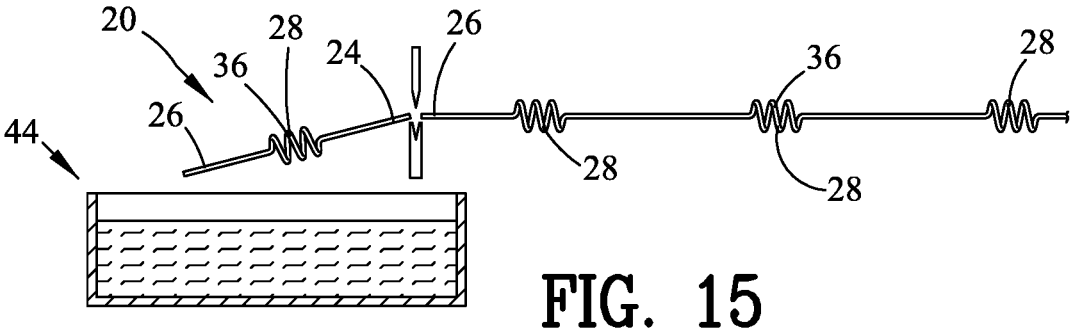
FIG. 15 illustrates the third step in forming the isolating hanger of the present invention of severing the wire between the heat treating spring shaped regions.

FIG. 5 again shows the first embodiment of the isolating hanger (20) of the present invention having a spring shaped (28) region defined in the bendable wire (22) between the first wire end (24) and the second wire end (26). The spring shaped (28) region is transformed into the resilient spring by a heating process with examples. This process is shown in FIGS. 11, 12 and 15. The first embodiment of the isolating hanger (20), shown in FIGS. 5 and 6, has a spring shaped (28) region that is between the first wire end (24) and the second wire end (26) that has a plurality of bends (30) in two dimensions (32). The first wire end (24) and the second wire end (26) remain bendable for affixing the isolating hanger (20) at the first and second wire ends (24) and (26).

Figure 7:
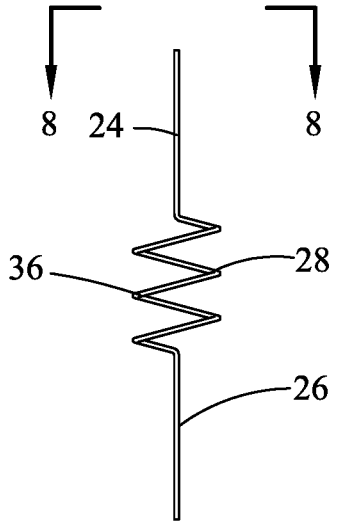
FIG. 7 is a second embodiment of the isolating hanger of the present invention.

FIG. 7 shows the second embodiment of the isolating hanger (20) of the present invention. Here the isolating hanger (20) has a spring shaped (28) region that is between the first wire end (24) and the second wire end (26) that has a helical bend (36) in three dimensions (34).

Figure 9:
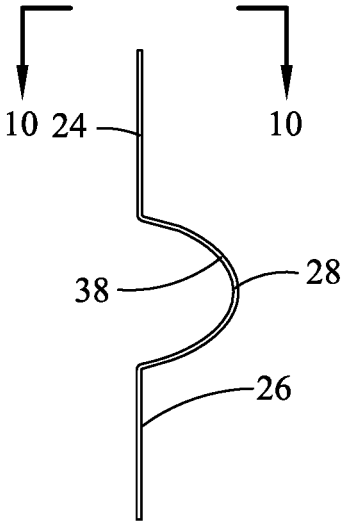
FIG. 9 is a third embodiment of the isolating hanger of the present invention.

FIG. 9 shows the third embodiment of the isolating hanger (20) of the present invention. Here the isolating hanger (20) has a spring shaped (28) region that is between the first wire end (24) and the second wire end (26) that consists of an arc bend (38) in three dimensions (34). A verity of spring shaped (28) region and dimensions of the spring shaped (28) region can vary from what is illustrated.

FIGS. 11-15 illustrate one of the two methods describing the process of making an isolating hanger (20). FIG. 11 shows an unformed bendable wire (22) that has a length that can extend to encompass one to many isolating hanger (20). The bendable wire (22) is typically made from a metallic material.

FIG. 12 illustrates a first step in forming the isolating hanger (20) of the present invention. FIG. 12 more precisely shows a series of helical bend (36) in three dimensions (34) of the isolating hanger (20) to be processed.

Figure 13:
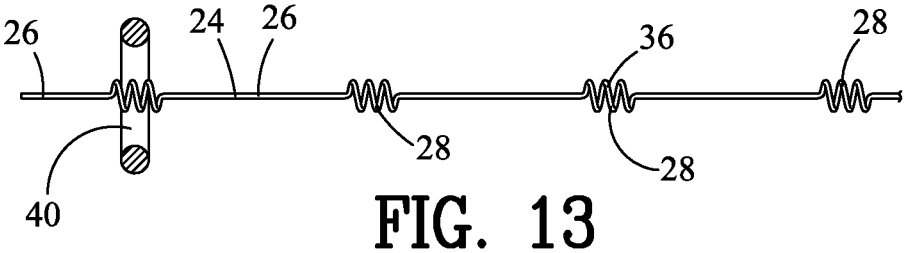
FIG. 13 illustrates the second step in forming the isolating hanger of the present invention including induction heating only the spring shapes of the bendable wire.

FIG. 13 illustrates how the spring shaped (28) in the isolating hanger (20) can be tempered for transforming the spring shape (28) into a resilient spring. The spring shaped (28) is tempered by a focused heat treating process that only heat treats the spring shaped (28). The spring shaped (28) region is located between the first wire end (24) and the second wire end (26) of the bendable wire (22). By focusing the heat treating process to only the spring shaped (28), the first wire end (24) and the second wire end (26) remains bendable. Remaining bendable allows for affixing the first wire end (24) of the bendable wire (22) to the upper support (16) and for affixing the second wire end (26) of the bendable wire (22) to the ceiling grid (12).

Figure 14:
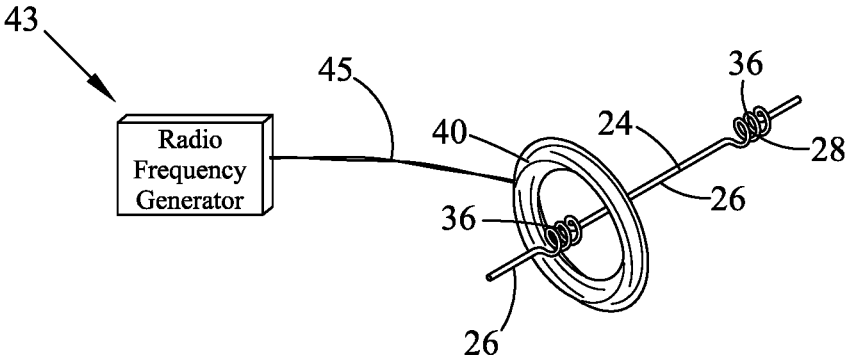
FIG. 14 is an enlarged isometric view of the induction heating portion of FIG. 13.

FIG. 14 is an enlarged isometric view of a portion of FIG. 13. Here it is better shown that the heating element (40) is a ring shaped coil (42) powered by a radio frequency generator (43) that can be energized only when the spring shaped (28) region passes within the center of the ring shaped coil (42). Once the spring shaped (28) region exits the ring shaped coil (42) the ring shaped coil (42) is deenergized. The use of a radio frequency induction heating should be well known to those skilled in the art.

FIG. 15 shows the severing process of the heat treated bendable wire (22) between spring shaped (28) region creating a first wire end (24) and the second wire end (26) of the isolating hanger (20). The isolating hanger (20) then drop into a chilling bath (44). The process of heating the spring shaped (28) region and rapidly cooling the spring shaped (28) region will cause the spring shaped (28) region to have a high strength and wear resistance. This heating and cooling process will increase the brittleness the spring shaped (28) region, but it will leave the spring shaped (28) region better to resist wear and erosion and preserving ductility and toughness to withstand shock loading and impact.

Figure 16:
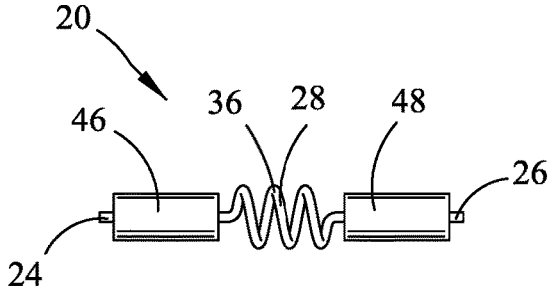
FIG. 16 illustrates applying a heatsink to the straight wire ends of the second embodiment of heat treating the bendable wire.

FIGS. 16-19 illustrate the second method of making an isolating hanger (20). FIG. 16 begins to show the steps of heat treating the spring shaped (28) region. In this method, the isolating hanger (20) is already severed into a separate isolating hanger (20) before the heat treating process has started. FIG. 16 shows the isolating hanger (20) having a first heatsink (46) attached to the first wire end (24) and a second heatsink (48) attached to the second wire end (26) of the isolating hanger (20).

Figure 17:
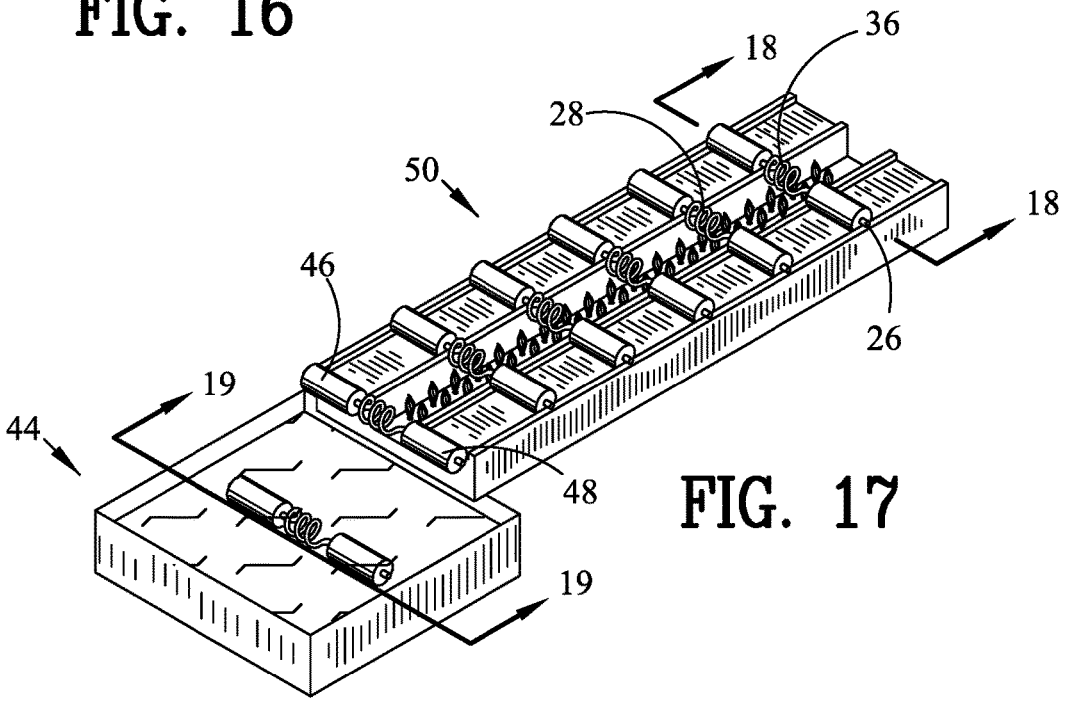
FIG. 17 illustrates the process in forming the second embodiment of the isolating hanger by flame heat treating only the spring shaped regions of the bendable wire.

Shown in FIG. 17, the isolating hanger (20), the first heatsink (46) and the second heatsink (48) progress alone a heat treating device (50) shown before dropping into a chilling bath (52). Again, this process of heating the spring shaped (28) region only and rapidly cooling the spring shaped (28) region will cause the spring shaped (28) region to have a high strength and wear and will preserve ductility and toughness to withstand shock loading and impact.

Figure 18:
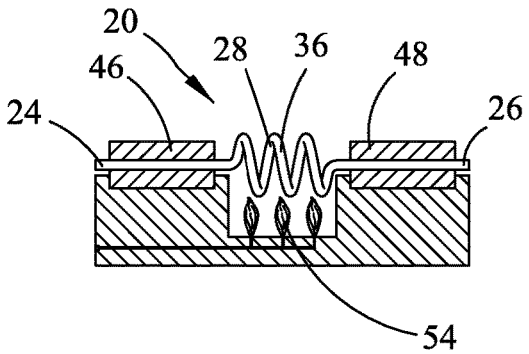
FIG. 18 is an enlarged sectional view along line 18-18 in FIG. 17.

FIG. 18 is an enlarged sectional view along line 18-18 in FIG. 17. It is shown in better detail how the flame (54) heats only the spring shaped (28) region of the isolating hanger (20) while the first heatsink (46) and the second heatsink (48) absorb any heat that is transferred to the first wire end (24) and the second wire end (26), respectively, of the isolating hanger (20).

Figure 19:
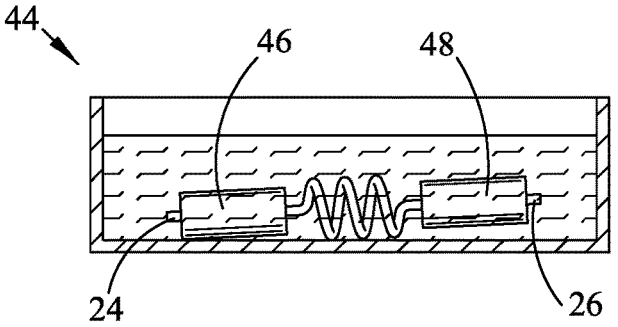
FIG. 19 is an enlarged sectional view along line 19-19 in FIG. 17.

FIG. 19 is an enlarged sectional view along line 19-19 in FIG. 17. FIG. 19 shows an isolating hanger (20) that has dropped into the chilling bath (52). The chilling bath (52) can be many different types of liquids, such as water or oil.

Figure 20:
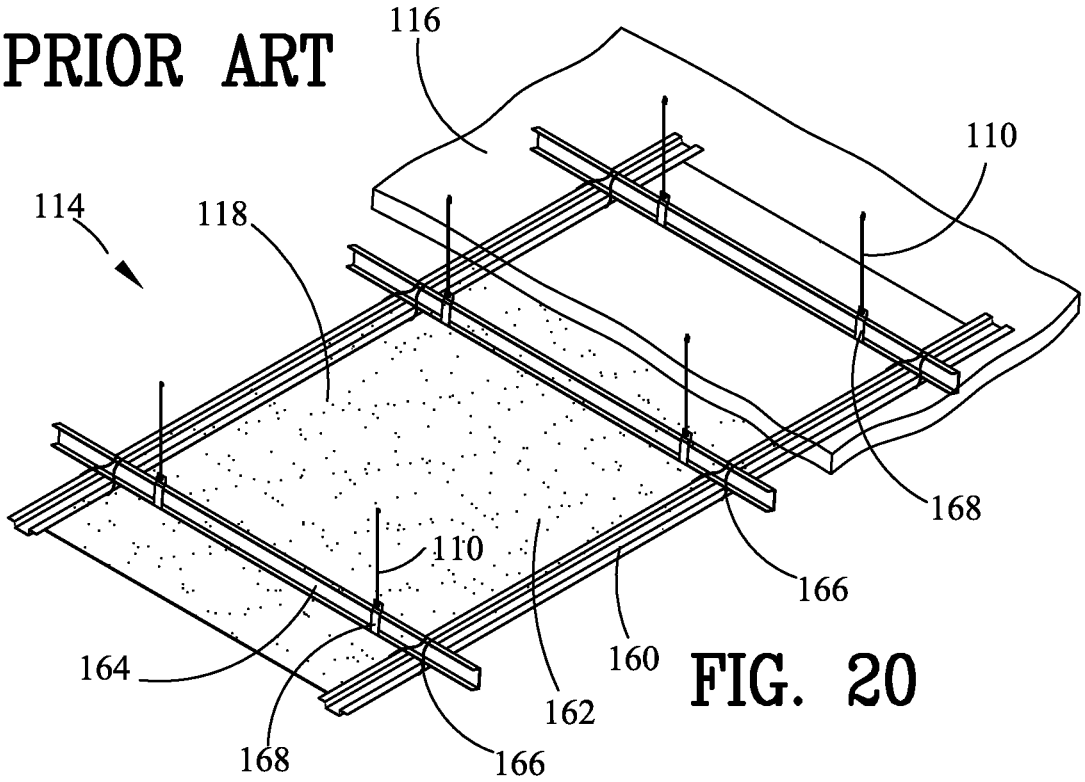
FIG. 20 PRIOR ART
FIG. 20 is a top isometric partially cut away view of a plurality of wire hangers of the prior art supporting a top hat ceiling grid of a suspended ceiling.

FIG. 20 is a top isometric partially cut away view of a plurality of wire hangers (110) of the prior art supporting a top hat ceiling grid (112) of a suspended ceiling (114). The top hat ceiling grid (112) contains top hat furring strips (160) that are grooved metal channels. The top hat furring strips (160) are used to support ceiling tiles (118), such as gypsum board (162). The top hat furring strips (160) are typically attached by means of preformed wire clips (166) to one or many U-channel beams (164). The U-channel beams (164) can either be fastened directly to the upper support (116) or have wire hangers (110) to provide separation of the upper support (116) from the suspended ceiling (114). When wire hangers (110) are used the first wire end (124) of the wire hangers (110) are attach to the upper support (116) and the second wire end (126) is attached to a channel brackets (168) that encompass the U-channel (164) giving the U-channel (164) support.

Figure 21:
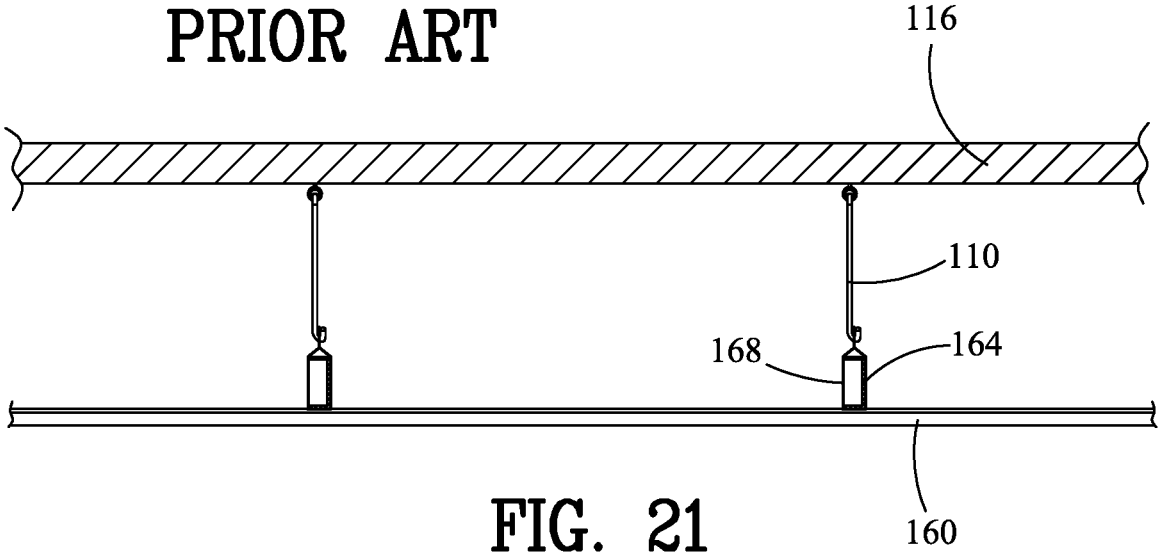
FIG. 21 is an enlarged side sectional view of a portion of FIG. 20.

FIG. 21 is an enlarged side sectional view of a portion of FIG. 20. FIG. 21 illustrates the prior art wire hangers (110) providing rigid support of the suspended ceilings (114) to the upper support (116).

Figure 22:
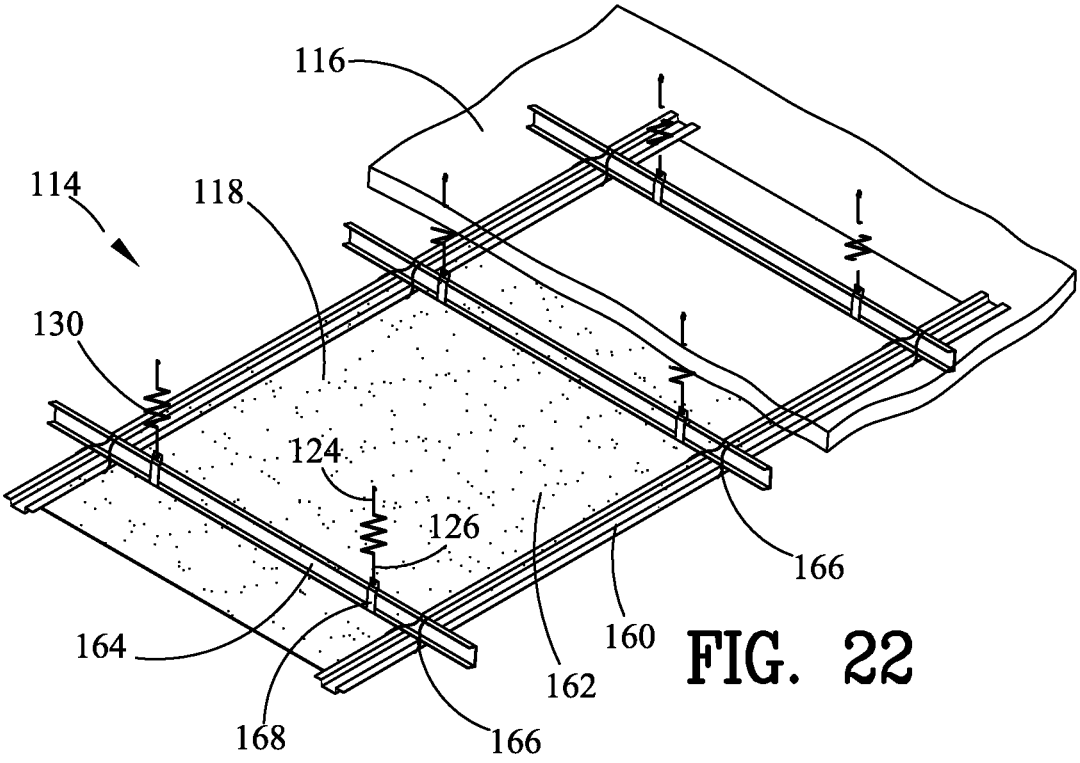
FIG. 22 is a top isometric partially cut away view of a plurality of wire hangers of the present invention supporting a top hat ceiling grid of a suspended ceiling.

FIG. 22 is a top isometric partially cut away view of a plurality of isolation hangers (120) of the present invention supporting a top hat ceiling grid (112) of a suspended ceiling (114). In FIG. 22 the prior art wire hangers (110) are replaced with the present invention isolation hangers (120).

Figure 23:
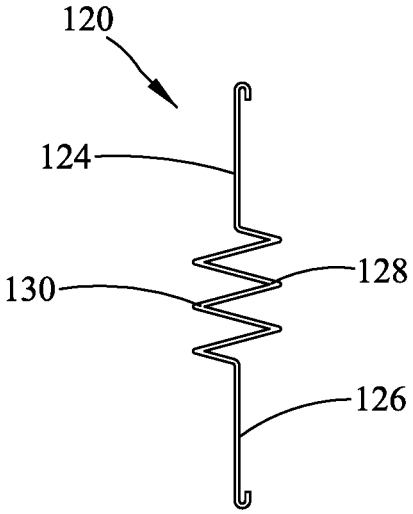
FIG. 23 is similar to FIG. 3 of the first embodiment of the isolating hanger of the present invention.
Figure 24:
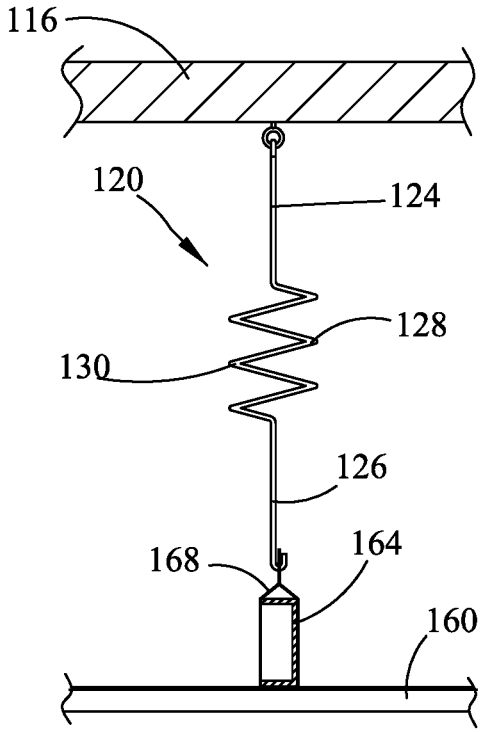
FIG. 24 is a side view of the isolating hanger of FIG. 23 supporting a top hat furring strips of a suspended ceiling from an upper support.

FIGS. 23-25 illustrate the isolating hanger (120) of the present invention supporting a hat channel for suspending the gypsum board (162). The isolation hanger (120) is a one piece bendable wire (122) that can be constructed from metallic material. The bendable wire (122) extends between a first wire end (124) and a second wire end (126). The diameter of bendable wire (122) can be larger than previously described to accommodate heavier or lighter suspended ceilings (114) or to provide extra strength to support suspended ceilings (114) accessories.

FIG. 24 is a side view of the isolating hanger of FIG. 23 supporting a top hat ceiling grid (112) from an upper support (116). The gypsum board (160) screwed to top hat ceiling grid (112). Preferably, one end of the isolation hanger (120) is connected to the ceiling (116) above and the other end of the isolation hanger (120) is connected to the top hat ceiling grid (112). The gypsum board (160) is then screwed into the top hat ceiling grid (112). The resilient isolation hanger (120) prevents sound transmission from the above floor (116) into the suspended ceiling. The gypsum board does not physically contact the walls in the room. There is a space between the edge of the gypsum board (160) and the walls (not shown) which is filled in with a resilient acoustical caulk (not shown), thus preventing sound transmission (flanking) from the walls to the ceiling.

The present invention provides an isolation hanger that can be manufactured rapidly within a small facility at minimal additional cost. The resilient isolation hanger requires no other parts, fixed or moving, that could wear out or disintegrate over time. The isolation hangar requires virtually limited tools to install and requires ordinary workers skilled in the suspended ceiling art.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An isolating hanger for mounting a ceiling from an upper support, comprising:

a bendable wire extending between a first wire end and a second wire end;

a spring shape defined in said wire between said first wire end and said second wire end;

said spring shaped being tempered for transforming said spring shape into a resilient spring; and said first wire end and said second wire end remaining bendable for affixing said first wire end of said bendable wire to the upper support and for affixing said second wire end of said bendable wire to the ceiling for isolating vibration between the ceiling and the upper support.

2. An isolating hanger for mounting a ceiling from an upper support as set forth in claim 1, wherein said ceiling includes a ceiling grid of a suspended ceiling.

3. An isolating hanger for mounting a ceiling from an upper support as set forth in claim 1, wherein the hanger is a one piece unit.

4. An isolating hanger for mounting a ceiling from an upper support as set forth in claim 1, wherein said bendable wire is a metallic wire.

5. An isolating hanger for mounting a ceiling from an upper support as set forth in claim 1, wherein said bendable wire includes a wire between 0.125 inches and 0.375 inches in diameter.

6. An isolating hanger for mounting a ceiling from an upper support as set forth in claim 1, wherein said spring shaped is transformed into said resilient spring by an induction beating process.

7. An isolating hanger for mounting a ceiling from an upper support as set forth in claim 1, wherein said spring shaped includes a plurality of bends in two dimensions.

8. An isolating hanger for mounting a ceiling from an upper support as set forth in claim 1, wherein said spring shaped includes a helical bend in three dimensions.

9. An isolating hanger for mounting a ceiling from an upper support as set forth in claim 1, wherein said spring shaped includes an arc bend in two dimensions.

10. An isolating hanger for mounting a ceiling from an upper support as set forth in claim 1, wherein said spring shaped is tempered by a focused heat treating process between said first wire end and said second wire end.

11. An isolating hanger for mounting a ceiling grid of a suspended ceiling from an upper support, comprising:

a bendable wire extending between a first wire end and a second wire end;

a spring shape defined in said wire between said first wire end and said second wire end;

said spring shaped being tempered for transforming said spring shape into a resilient spring; and said first wire end and said second wire end remaining bendable for affixing said first wire end of said bendable wire to the upper support and for affixing said second wire end of said bendable wire to the ceiling grid for isolating vibration between the suspended ceiling and the upper support.

12. An isolating hanger for mounting a ceiling from an upper support as set forth in claim 11, wherein the hanger is a one piece unit.

13. An isolating hanger for mounting a ceiling from an upper support as set forth in claim 11, wherein said bendable wire is a metallic wire.

14. An isolating hanger for mounting a ceiling from an upper support as set forth in claim 11, wherein said spring shaped is transformed into said resilient spring by an induction heating process.

15. An isolating hanger for mounting a ceiling from an upper support as set forth in claim 11, wherein said spring shaped includes a plurality of bends in two dimensions.

16. An isolating hanger for mounting a ceiling from an upper support as set forth in claim 11, wherein said spring shaped includes a helical bend in three dimensions.

17. An isolating hanger for mounting a ceiling from an upper support as set forth in claim 11, wherein said spring shaped includes an arc bend in two dimensions.

18. An isolating hanger for mounting a ceiling from an upper support as set forth in claim 11, wherein said spring shaped is tempered by a focused heat treating process between said first wire end and said second wire end.

* * * * *